US006942298B2

(12) United States Patent
Harrison

(10) Patent No.: US 6,942,298 B2
(45) Date of Patent: Sep. 13, 2005

(54) FIVE-PART FURNITURE FRAME AND METHOD OF ASSEMBLY

(76) Inventor: Larry W. Harrison, 1097 Cr 146, New Albany, MS (US) 38652

( * ) Notice: Subject to any disclaimer, the term of this patent is extended or adjusted under 35 U.S.C. 154(b) by 30 days.

(21) Appl. No.: 10/682,341

(22) Filed: Oct. 10, 2003

(65) Prior Publication Data

US 2004/0140706 A1 Jul. 22, 2004

Related U.S. Application Data

(60) Provisional application No. 60/440,649, filed on Jan. 17, 2003.

(51) Int. Cl.[7] ..... A47C 7/00

(52) U.S. Cl. ..... 297/440.1; 297/44.23; 297/440.2

(58) Field of Search ..... 297/440.1, 440.2, 297/440.15, 440.23

(56) References Cited

U.S. PATENT DOCUMENTS

| | | | | | |
|---|---|---|---|---|---|
| 4,074,919 | A | * | 2/1978 | Watts | 297/440.1 |
| 4,140,065 | A | | 2/1979 | Chacon | |
| 4,165,902 | A | | 8/1979 | Ehrlich | |
| 5,080,438 | A | * | 1/1992 | Moyer | 297/440.23 |
| 5,678,897 | A | | 10/1997 | Prestia | |
| 5,738,414 | A | * | 4/1998 | Wieland et al. | 297/440.1 |
| 5,890,767 | A | | 4/1999 | Chang | |
| 6,241,317 | B1 | | 6/2001 | Wu | |
| 6,367,880 | B1 | | 4/2002 | Niederman et al. | |
| 2002/0093235 | A1 | | 7/2002 | Niederman et al. | |

* cited by examiner

*Primary Examiner*—Peter R. Brown
(74) *Attorney, Agent, or Firm*—Richard C. Litman

(57) ABSTRACT

The present invention is a five-part furniture frame, and method of assembly thereof, consisting of a left arm frame, a right arm frame, a seat box frame, an inside back frame and an outside back frame. The invention allows for ease of assembly and for a seat back that incorporates a triangular structure for added stability and durability.

2 Claims, 13 Drawing Sheets

FIVE-PART FURNITURE FRAME AND METHOD OF ASSEMBLY

CROSS-REFERENCE TO RELATED APPLICATION

This application claims the benefit of U.S. Provisional Patent Application Ser. No. 60/440,649, filed Jan. 17, 2003.

BACKGROUND OF THE INVENTION

1. Field of the Invention

The present invention relates to furniture and, more particularly, to furniture that can be easily assembled and disassembled, and to a method for assembling such furniture.

2. Description of Related Art

Furniture that can be easily assembled and disassembled is known in the related art. Examples of such furniture are provided by U.S. Pat. No. 4,140,065 issued Feb. 20, 1979 to L. M. Chacon (modular furniture); U.S. Pat. No. 4,165,902 issued Aug. 28, 1979 to R. A. Ehrlich (knockdown upholstered furniture); U.S. Pat. No. 5,678,897 issued Oct. 21, 1997 to J. C. Prestia (ready-to-assemble upholstered furniture); U.S. Pat. No. 5,890,767 issue Apr. 6, 1999 to Y. F. Chang (modular sofa); U.S. Pat. No. 6,241,317 issued Jun. 5, 2001 to J. Wu (modular chair construction) and both U.S. Pat. No. 6,367,880 issued Apr. 9, 2002 to A. G. Niederman et al. and U.S. Pat. App. Pub. No. US2002/0093235 published Jul. 18, 2002 on behalf of A. G. Niederman et al. (modular upholstered furniture construction). Such furniture—often referred to as modular furniture—provides two basic advantages over conventional furniture. First, it is easier to move than conventional furniture. For example, prior to assembly, modular furniture can be readily moved through restricted doorways, hallways and stairways whereas conventional furniture is often too bulky or heavy to pass easily through restricted spaces. And second, because it requires less space when disassembled, modular furniture is less expensive both to ship and to store than conventional furniture.

However, despite its advantages, there are at least two recognized drawbacks of modular furniture. First, modular furniture typically is difficult and time consuming to assemble, particularly for end users. As taught by U.S. patent application Ser. No. 2002/0093235 to Neiderman et al., assembly normally requires two people to either line up brackets or hold the modular sections in place prior to joining. Second, modular furniture typically is not as rigid as conventional furniture. As taught by U.S. Pat. No. 5,678,897 to Prestia, modular furniture tends "to loosen over time" and therefore is less "sturdy and durable" than conventional furniture.

As a result, there is a need for modular furniture that is easier to assemble and that is more stable and durable once assembled than modular furniture known in the art. Additionally, there is a need for a method of assembling such furniture.

With regard to the related art, the device taught by Prestia bears some structural resemblance to the present invention but differs in at least one important structural respect. While the Prestia device consists of four interconnected components with one component comprising a seat back section, the present invention consists of five interconnected components with two components forming a seat back section. With two components, the seat back section incorporates a triangular structure relative to the seat box and arm frames. This unique triangular structural relationship of the present invention provides both added stability and durability. Thus, none of the above mentioned related art, taken either singularly or in combination, is seen to describe the present invention as claimed.

SUMMARY OF THE INVENTION

The present invention is a five-part furniture frame, and method of assembly thereof, consisting of a left arm frame, a right arm frame, a seat box frame, an inside back frame and an outside back frame. The invention allows for ease of assembly and for a seat back that incorporates a triangular structure for added stability and durability.

Accordingly, it is a principal object of the invention to provide a method for assembling furniture that is simpler and less time consuming than known methods.

It is another object of the invention to provide modular furniture that can be easily assembled and disassembled by both manufacturers and end users.

It is a further object of the invention to provide modular furniture constructed in manner that allows for improved stability and durability.

Additionally, it is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a five-part furniture frame, and method of assembly thereof, consisting of a left arm frame, a right arm frame, a seat box frame, an inside back frame and an outside back frame.

Figure 10:
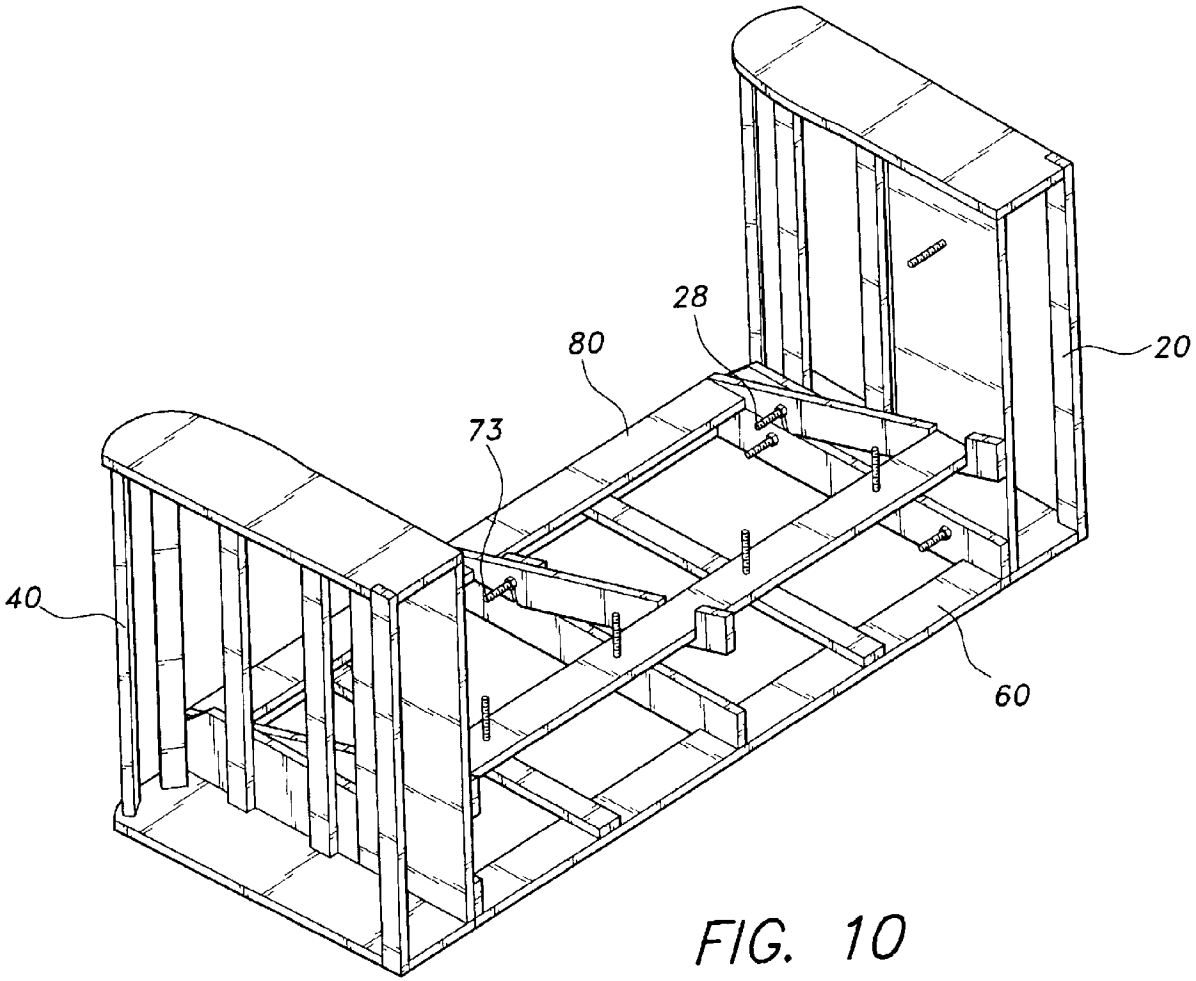
FIG. 10 is an illustration of the third step of a method for assembling a five-part furniture frame according to the present invention.
Figure 11:
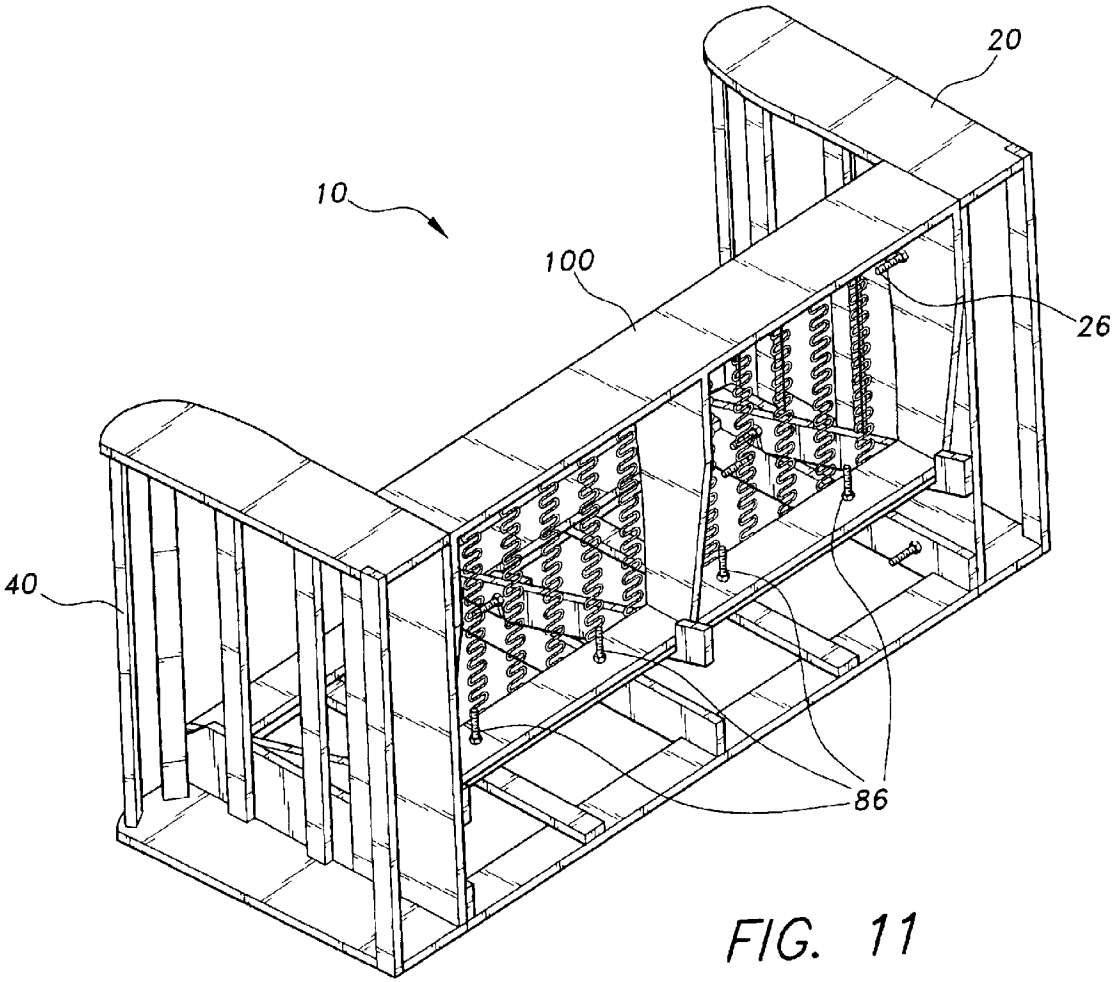
FIG. 11 is an illustration of the fourth step of a method for assembling a five-part furniture frame according to the present invention.
Figure 12:
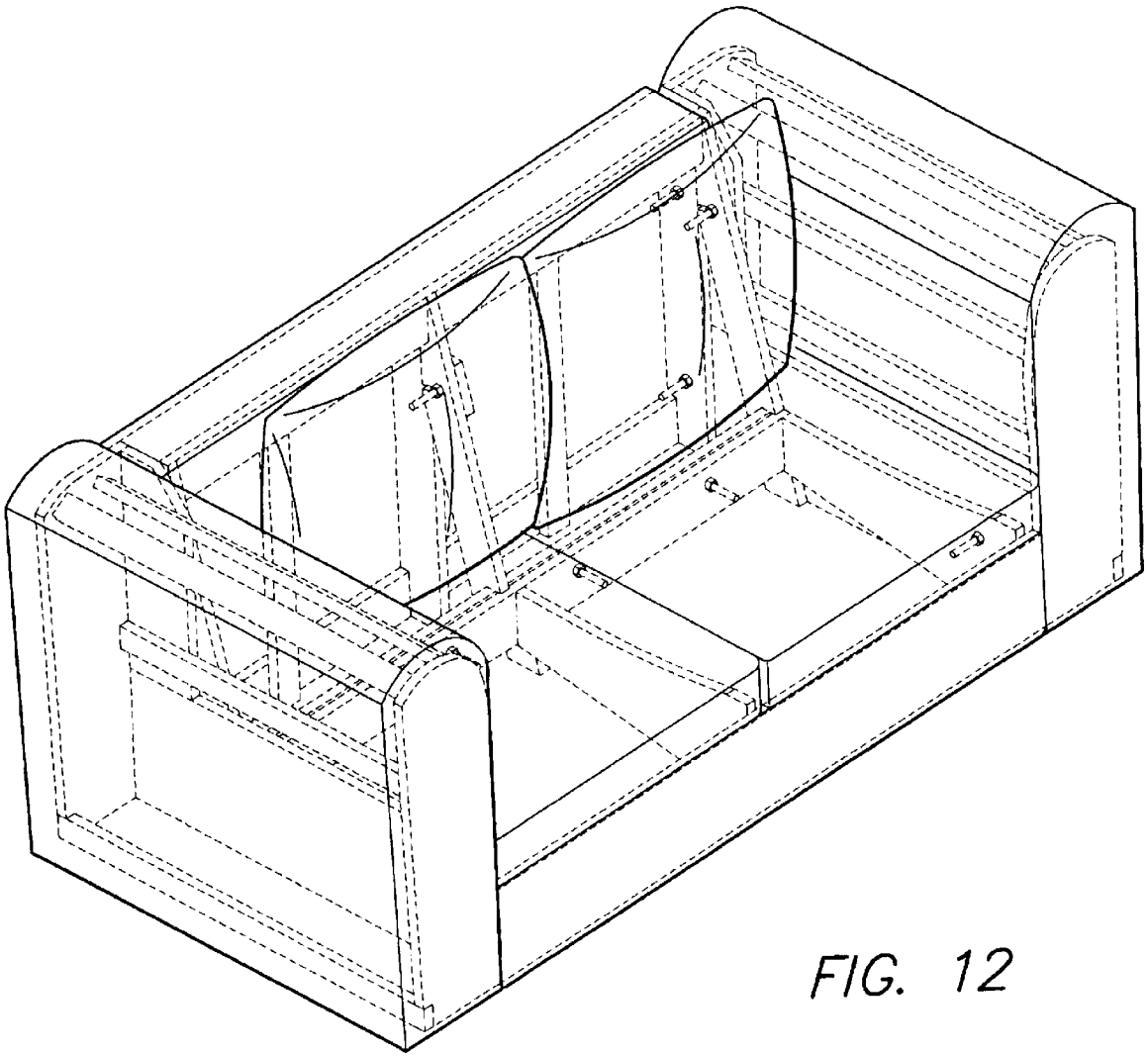
FIG. 12 is an elevational view of a sofa incorporating the five-part furniture frame according to the present invention, with the five-part furniture frame shown in hatched lines.

Referring to the drawings, FIGS. 1 to 6 depict the preferred embodiment of the five-part furniture frame, FIGS. 7 through 11 illustrate a method for assembling the five-part furniture frame, and FIG. 12 illustrates the five-part furniture frame as incorporated in a piece of furniture.

Figure 1:
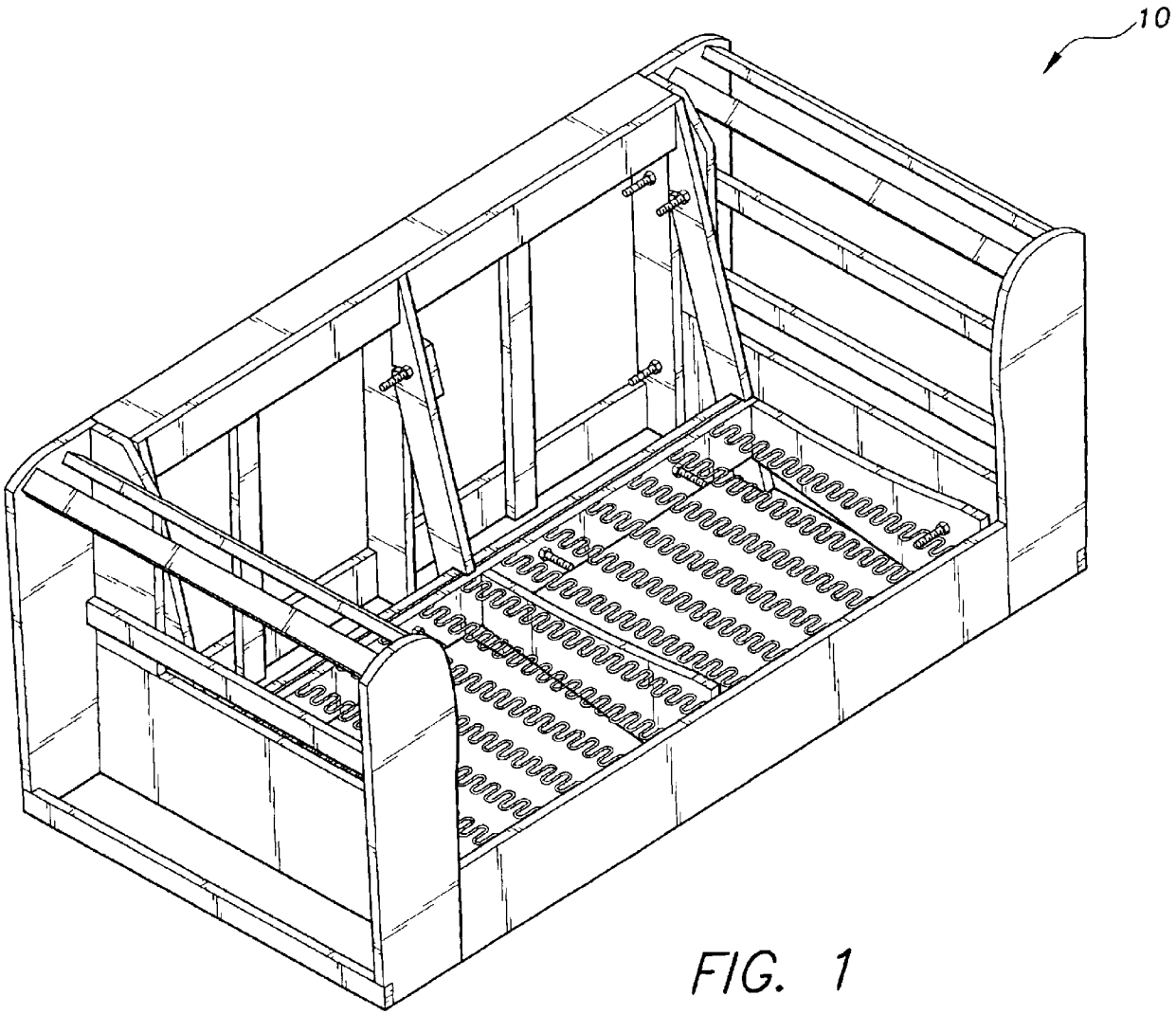
FIG. 1 is an elevational, perspective view of a five-part furniture frame according to the present invention.
Figure 2:
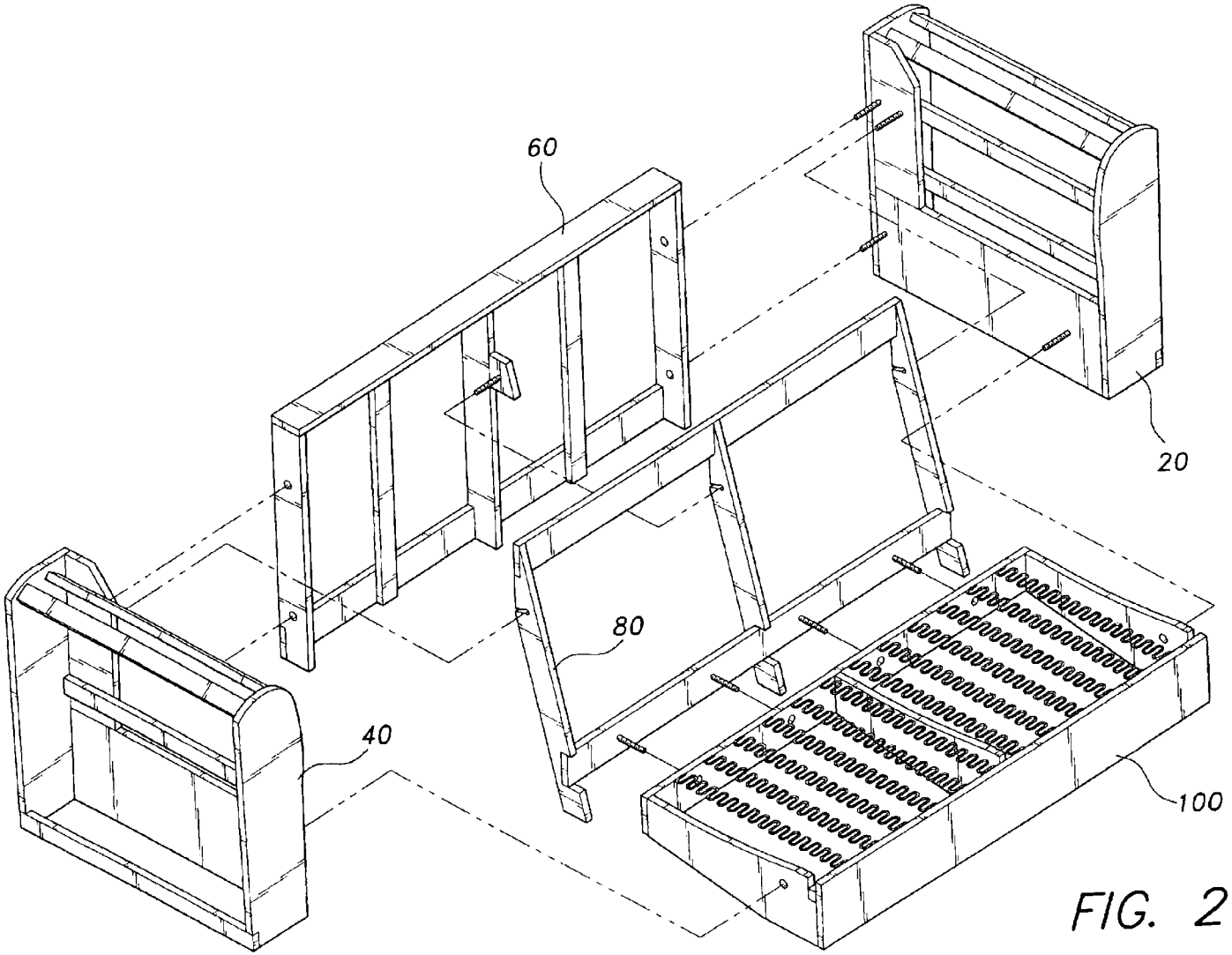
FIG. 2 is an exploded view of FIG. 1.
Figure 3A:
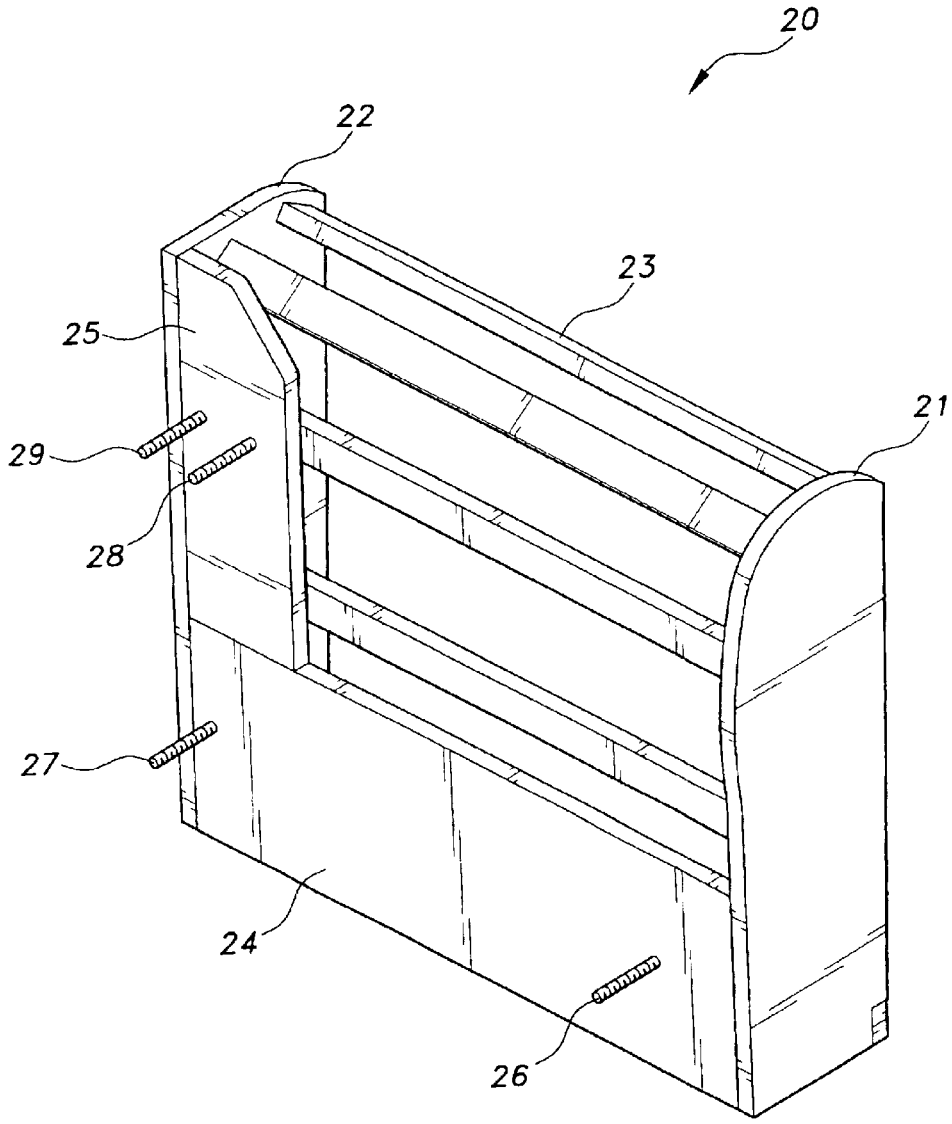
FIG. 3A is an elevational, perspective view of a right arm frame according to the present invention.
Figure 3B:
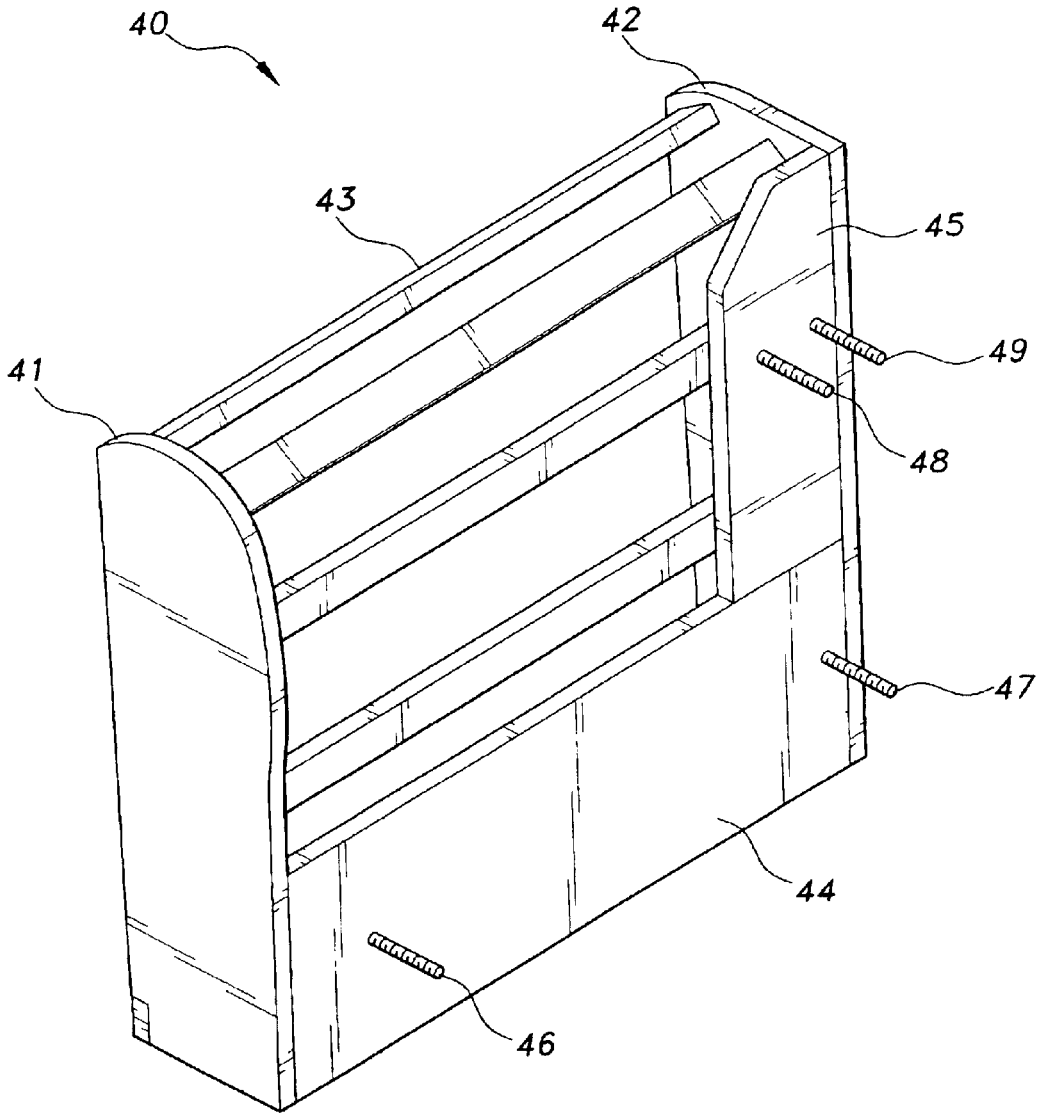
FIG. 3B is an elevational, perspective view of a left arm frame according to the present invention.

FIG. 2 shows the five main components of the five-part furniture frame 10 with each bolt shown relative to its corresponding opening in a component. The five-part furniture frame 10 is comprised of a left arm frame 40, a right arm frame 20, a seat box frame 100, an inside back frame 80, and an outside back frame 60.

Figure 4:
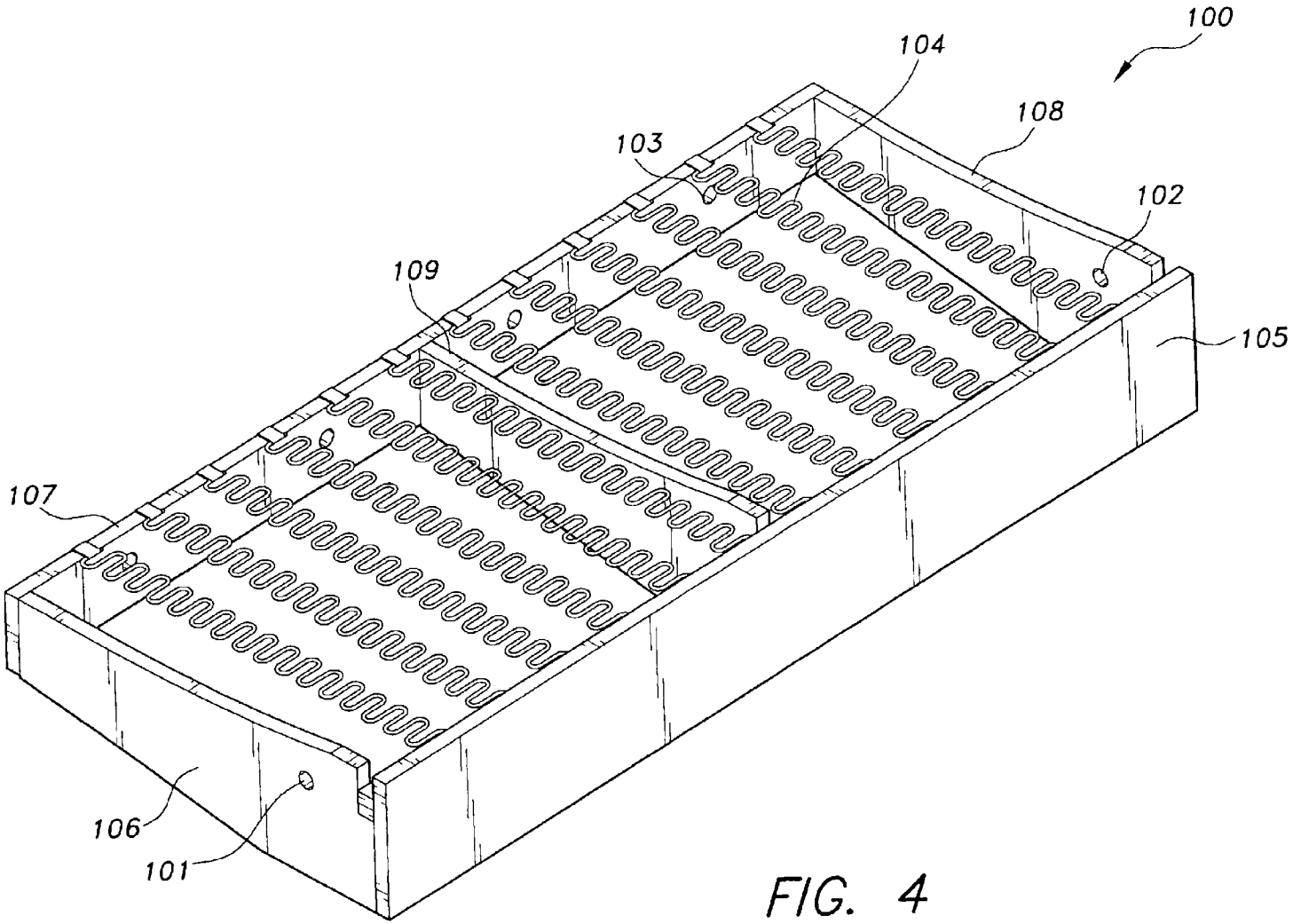
FIG. 4 is an elevational, perspective view of a seat box frame according to the present invention.
Figure 5:
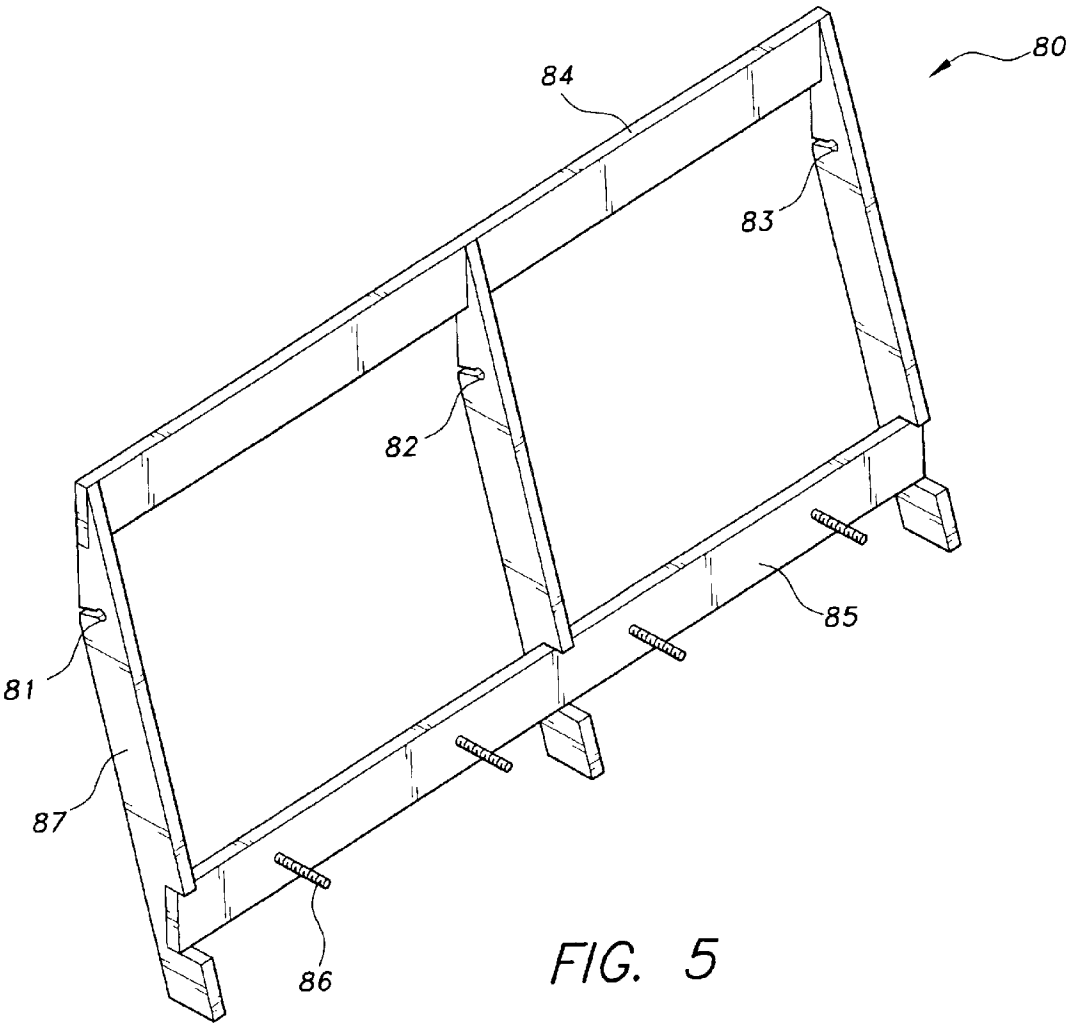
FIG. 5 is an elevational, perspective view of an inside back frame according to the present invention.

The left arm frame 40 and right arm frame 20 (FIGS. 3A and 3B) each have four bolts extending from one of its sides. Each arm frame 20 and 40 has a front panel 21 and 41 and a back panel 22 and 42 between which a number of crossbars 23 and 43 are secured. Mounted on the inner side of each arm frame 20 and 40 are two panels 24, 25, 44 and 45, each of which has two bolts 26–29 and 46–49 extending perpendicularly there from. One bolt 26 and 46 from each arm frame mates to a corresponding opening 101 and 102 in the seat box frame 100 (FIG. 4). Another bolt 28 and 48 from each arm frame mates to a corresponding opening 81 and 83 in the inside back frame 80 (FIG. 5). And two bolts 27, 29, 47 and 49 from each arm frame 20 and 40 mate to corresponding openings 61–64 in the outside back frame 60 (FIG. 6).

The seat box frame 100, shown in FIG. 4, has a front panel 105, a back panel 107, and two side panels 106 and 108. A crossbar panel 109 runs from the middle of the back panel 107 to the middle of the front panel 105. Twelve planar tension springs 104 run from the top edge of the back panel 107 to the top edge of the front panel 105. The back panel has four openings 103 which mate to bolts 86 mounted on the inside back frame 80.

The inside back frame 80, shown in FIG. 5, has an upper panel 84 and a lower panel 85 with three crossbars 87 running between them 84 and 85. Each crossbar has a notch 81–83 in which a bolt can be inserted. The lower panel 85 has four bolts extending perpendicularly from one side thereof 85.

Figure 6:
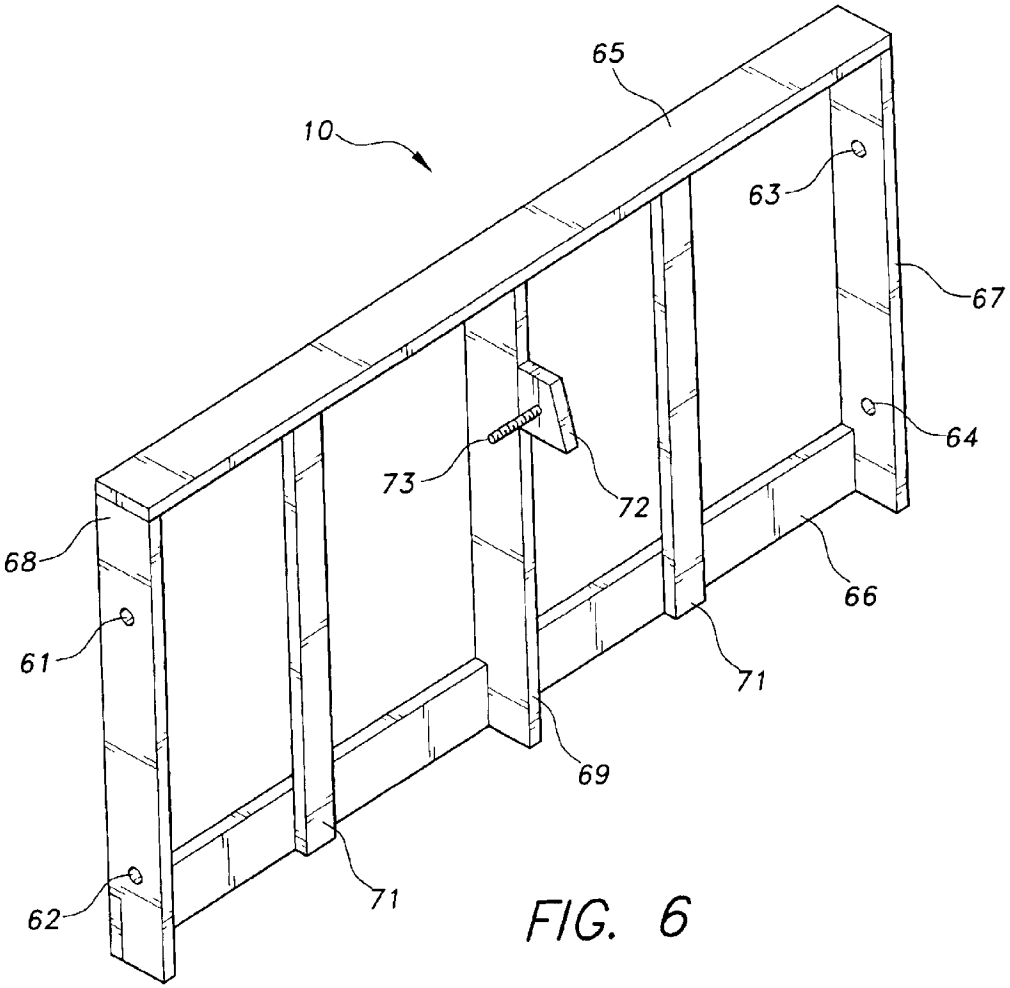
FIG. 6 is an elevational, perspective view of an outside back frame according to the present invention.

The outside back frame 60, shown in FIG. 6, has a top panel 65, a bottom panel 66, and two side panels 67 and 68. Three crossbars 69 and 71 run between the top and bottom panels 65 and 66. Mounted on the center crossbar 69 is a flange 72 to which a bolt 73 is attached.

Figure 7:
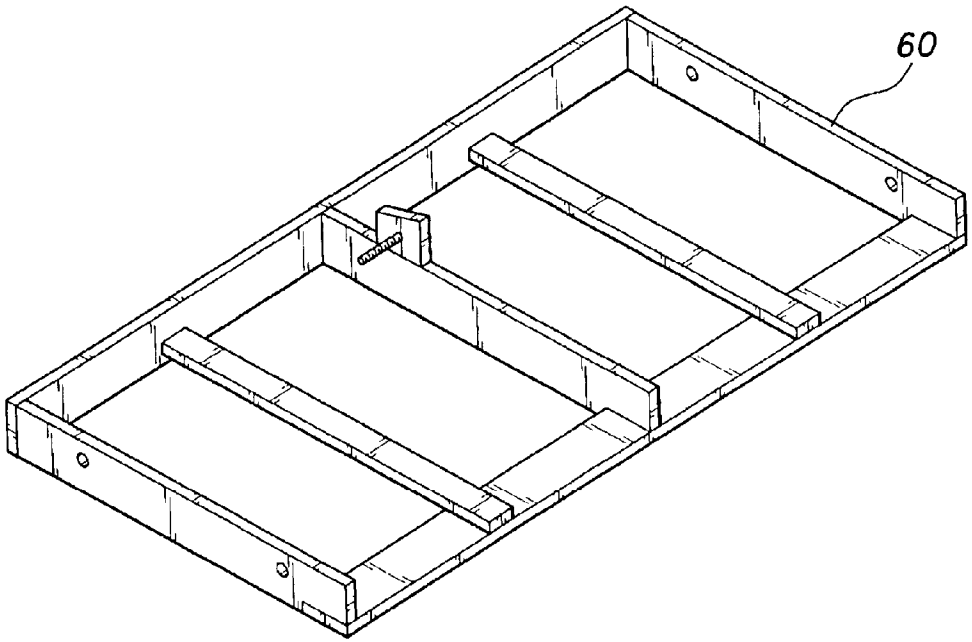
FIG. 7 is an illustration of the first step of a method for assembling a five-part furniture frame according to the present invention.

As shown in FIG. 7, the first step in the method of assembling the above described five-part furniture frame is to lay the outside back frame on a flat surface.

Figure 8:
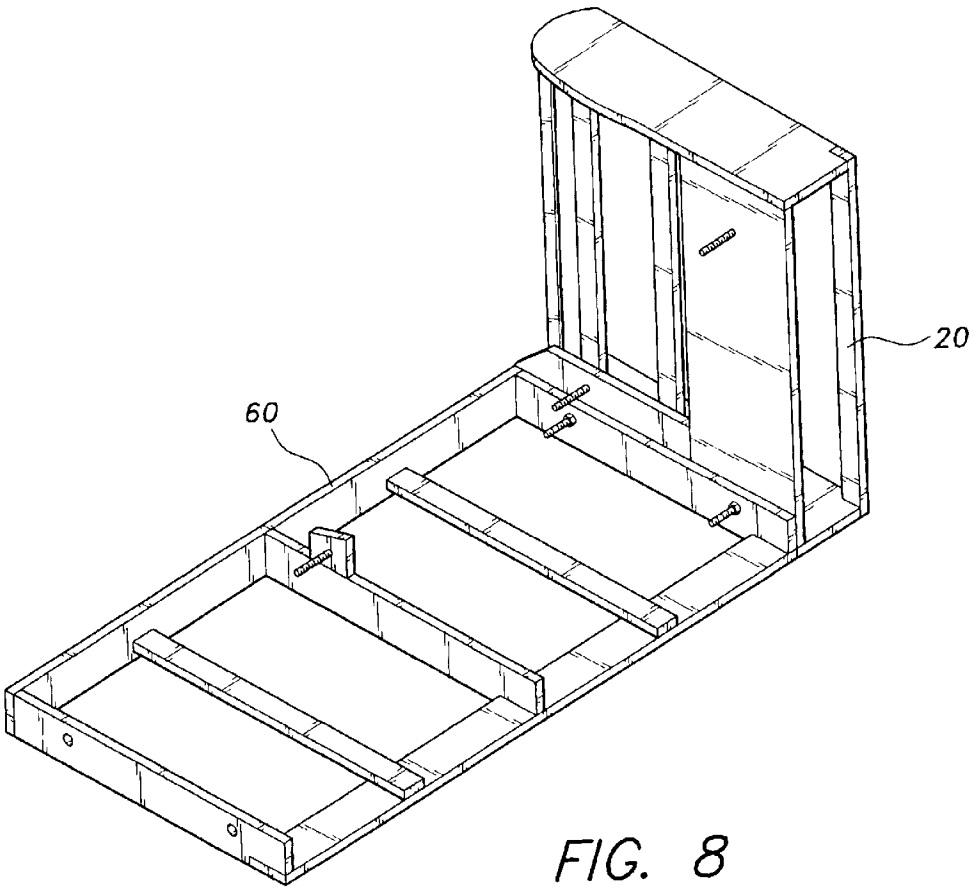
FIGS. 8 and 9 are an illustration of the second step of a method for assembling a five-part furniture frame according to the present invention.
Figure 9:
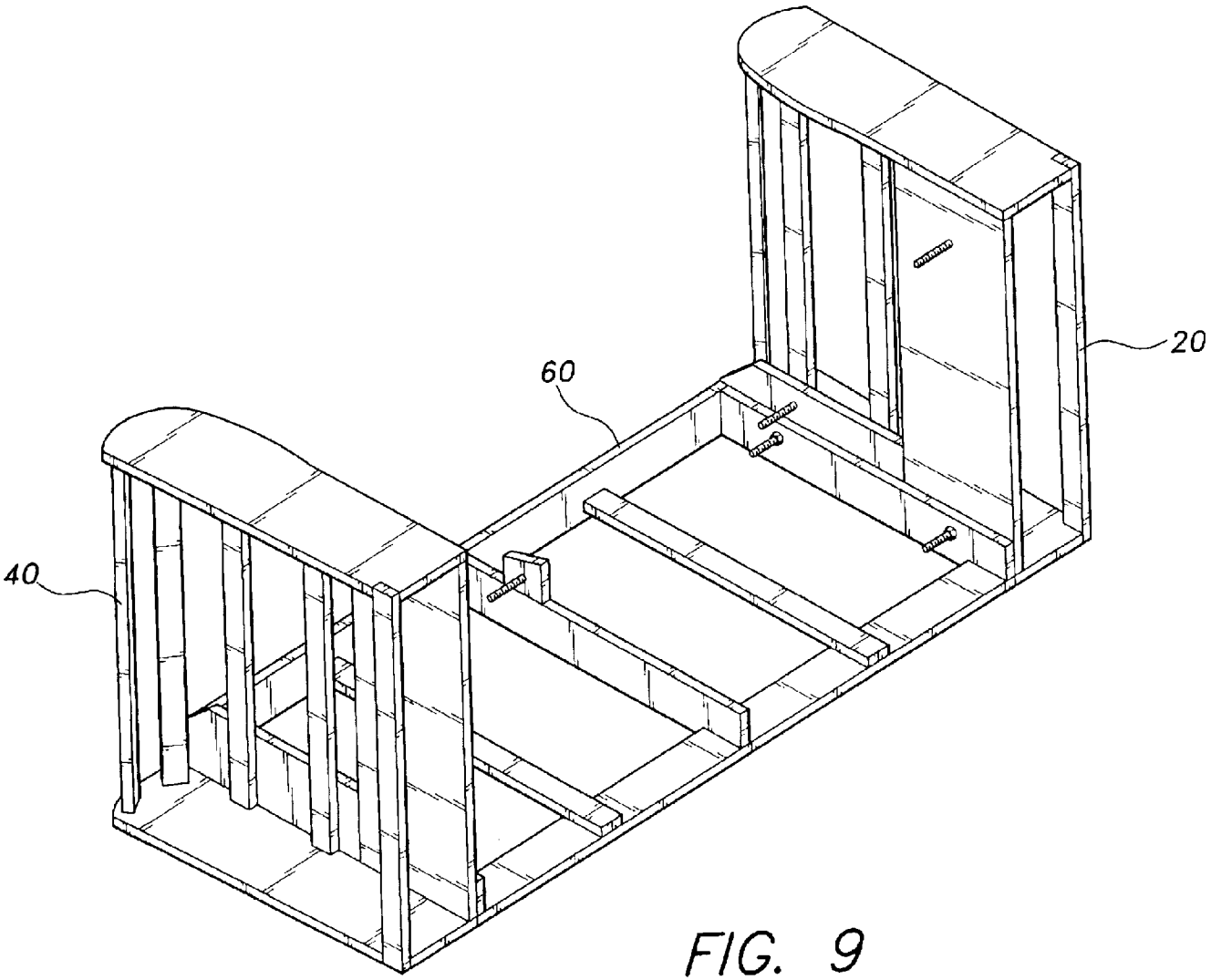

The second step in the method of assembly according to the present invention is to secure the left and right arm frames 20 and 40 to the outside back frame 60, as shown in FIGS. 8 and 9, by inserting two bolts on each of the left and right arm frames 20 and 40 into their corresponding openings in the outside back frame 60 and by attaching a nut to each bolt.

The third step in the method of assembly according to the present invention, as shown in FIG. 10, is to lower the inside back frame 80 onto the assembly resulting from the second step such one notch 82 slides onto its corresponding bolt 73 on the outside back frame, one notch 83 slides onto its corresponding bolt 28 on the right arm frame, and one notch 81 slides onto its corresponding bolt 48 (not shown) on the left arm frame and to attach a nut to each bolt.

The fourth step in the method of assembly according to the present invention, as shown in FIG. 11, is to lower the seat back frame 100 onto the assembly resulting from the third step such that the bolts 86 attached to the inside back frame's lower panel are inserted into the openings 103 in the seat box frame's back panel. To lower the seat box frame 100 onto the assembly, the left and right arm frames 20 and 40 must be moved distally from the assembly. Once the seat box frame 100 is in place, the arm frames 20 and 40 are move back into place such that one bolt on each arm frame 20 and 40 is inserted into its corresponding opening on one of the seat box frame's 100 side panels. Nuts are then attached to each of the bolts.

The fifth step in the method of assembly according to the present invention is to tighten all nuts on the resulting furniture frame 10.

FIG. 12 shows a sofa with a pliable material upholstered to the five-part furniture frame according to the present invention. It will be appreciated that the pliable material can be upholstered to the five-part furniture frame either before or after the frame is assembled. For ease of understanding, FIGS. 1 through 11 show assembly of the invention's components prior to upholstering.

Significantly, it will be appreciated from drawings 1, 2, 10, and 11 that, when assembled, the five-part furniture frame 10 incorporates a triangular structural relationship formed by the attachment of the inside back frame 60 to the outside back frame 80 at an angle of between 0° and 90°, the attachment of the outside back frame to both arm frames, and the attachment of both arms frames to the inside back frame via the seat box frame. This triangular structural relationship provides added rigidity and stability to the furniture frame 10.

It is to be understood that the present invention is not limited to the embodiment described above, but encompasses any and all embodiments within the scope of the following claims.

I claim:

1. A method of assembling a five-part furniture frame consisting of a left arm frame, a right arm frame, a seat box frame, an inside back frame and an outside back frame comprising:

(a) placing said outside back frame on a flat surface;

(b) securing said left arm frame and said right arm frame to said outside back frame;

(c) securing said inside back frame to said outside back frame, said left arm frame and said right arm frame; and (d) securing seat box frame to said inside back frame, said left arm frame and said right arm frame.

2. A method of assembling a five-part furniture frame consisting of a left arm frame, a right arm frame, a seat box frame, an inside back frame and an outside back frame interconnected via bolts comprising:

(a) placing said outside back frame on a flat surface;

(b) inserting bolts attached to said left arm frame and said right arm frame into corresponding openings in said outside back frame by positioning said left arm frame and said right arm frame next to said outside back frame and securing one nut to each of said bolts;

(c) inserting bolts attached to said outside back frame, said left arm frame and said right arm frame into corresponding openings in said inside back frame by positioning said inside back frame next to said outside back frame, said left arm frame and said right arm frame, and securing one nut to each of said bolts;

(d) inserting bolts attached to said inside back frame, said left arm frame and said right arm frame into corresponding openings in said seat box frame by positioning said seat box frame next to said inside back frame, said left arm frame and said right arm frame, and securing one nut to each of said bolts; and (e) tightening all nuts.

* * * * *